US009279244B1

(12) United States Patent
Miller

(10) Patent No.: US 9,279,244 B1
(45) Date of Patent: Mar. 8, 2016

(54) APPARATUS FOR SUPPORTING STAY-IN-PLACE METAL DECKING FORMS

(71) Applicant: Travis Miller, Lehi, UT (US)

(72) Inventor: Travis Miller, Lehi, UT (US)

( * ) Notice: Subject to any disclaimer, the term of this patent is extended or adjusted under 35 U.S.C. 154(b) by 0 days.

(21) Appl. No.: 14/525,203

(22) Filed: Oct. 27, 2014

(51) Int. Cl.
*E04B 1/24* (2006.01)
*E04B 1/41* (2006.01)
*E04B 1/38* (2006.01)

(52) U.S. Cl.
CPC ..... *E04B 1/24* (2013.01); *E04B 1/2403* (2013.01); *E04B 1/40* (2013.01); *E04B 2001/2415* (2013.01); *E04B 2001/405* (2013.01)

(58) Field of Classification Search
CPC . E04B 1/24; E04B 2001/2415; E04B 1/2612; E04B 1/2608; E04B 1/40; E04B 5/32; E04B 5/10; E04B 2103/06; E04B 2005/324; E04B 2001/405; E01D 19/125
USPC ..... 52/702
See application file for complete search history.

(56) References Cited

U.S. PATENT DOCUMENTS 610,832 A * 9/1898 Robinson ..... 52/326
3,972,169 A * 8/1976 Sheppard, Jr. ..... 52/702
4,982,548 A * 1/1991 Abbey ..... 52/702
5,025,522 A * 6/1991 Eskew et al. ..... 14/73
8,091,316 B2 * 1/2012 Beck et al. ..... 52/650.1
8,234,827 B1 * 8/2012 Schroeder et al. ..... 52/334

OTHER PUBLICATIONS

Bridge Deck Solutions, "Accessories for Formspan Bridge Decking", http://bridgedecksolutions.com/wp-content/uploads/2014/05/BDS_Accessories.pdf, Jun. 2014, pp. 3, Latrobe, PA.
Defreese, "Polymer Coated Stay-In-Place Metal Bridge Deck Forms", FICE/FDOT Design Conference, Aug. 2006, Session #25, pp. 23, Orlando, Florida.

* cited by examiner

*Primary Examiner* — Andrew J Triggs
(74) *Attorney, Agent, or Firm* — Thorpe North & Western, LLP

(57) ABSTRACT

A system and method for supporting and positioning stay in place metal decking between support girders which have a substantially horizontal top surface with opposite side edges defining a width of the substantially horizontal top surface, includes a plurality of straps for placement on the substantially horizontal top surface of the support girder and having substantially vertical end portions at the ends thereof substantially aligned with the opposite edges of the substantially horizontal top surface, and a pair of angle irons, one side of each angle iron forming the height of the angle iron adapted to be adjustably attached to and to be adjustably vertically positioned with respect to the vertical end portions of the strap, and the width of the angle iron being sufficient for holding the edge of a metal decking pan. Wind clips can be installed to hold the assembly in position in high wind conditions.

17 Claims, 5 Drawing Sheets

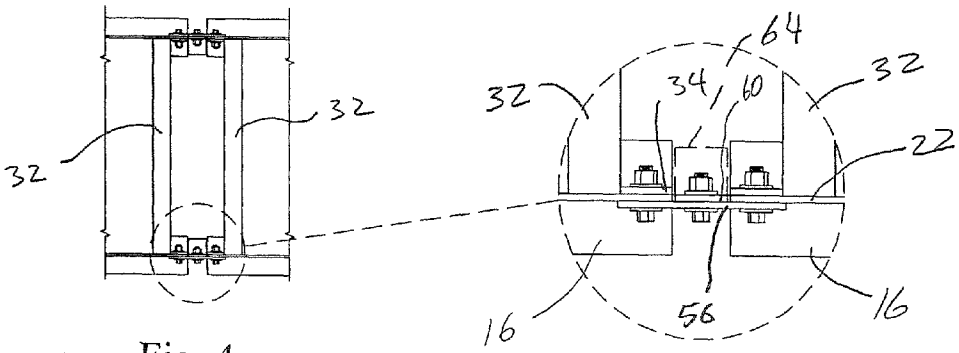
Fig. 4A
Fig. 4
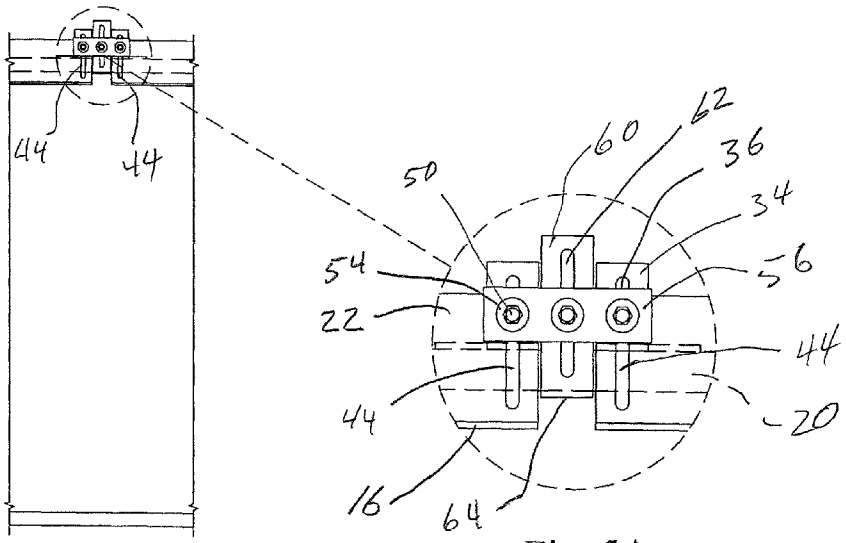
Fig. 5A
Fig. 5

APPARATUS FOR SUPPORTING STAY-IN-PLACE METAL DECKING FORMS

BACKGROUND

1. Field

The invention is in the field of Stay-In-Place decking forms for constructing concrete decking.

2. State of the Art

It is currently common practice in the construction of bridges, such as highway bridges, to erect a series of parallel bridge support girders in the form of I beams. Deck pans, such as corrugated metal pans, are installed between the parallel girders to close the space between the girders and provide a receiving form for concrete poured across the pans and girders to form a concrete bridge deck. The deck pans are supported between the girders by the horizontally extending surfaces of angle irons which extend along the longitudinal sides of the girders. The angle irons are attached by welding to the ends of straight flat straps which extend over the top surface of the girders. It is important to mount the deck pans at a desired height with respect to the upper surfaces of the girders so as to provide support for a desired thickness of the concrete deck and surface contour when concrete is poured into the pans and across the tops of the girders and smoothed to provide a smooth top concrete surface for the bridge. Since the deck pans are supported by the angle irons, it is important that the angle irons which support the deck pans at the desired height along the sides of the girders be properly secured by the straps at the desired height. Therefore, the vertical positioning of the angle irons along the sides of the girders is important. Once the girders are erected, the top surface of the girders are surveyed to determine the distance down from or up from the top of the girders to mount the angle irons. As the girders are surveyed, it is determined where the angle irons should be positioned with respect to the top surface of the girder to provide the desired top surface contour of the concrete deck. The determined position of the angle iron at a particular survey location along the length of the support girder is marked on the top surface of the support girder usually as either a "−" meaning "cut" or "+" meaning "fill" along with a measurement such as ½, meaning ½ inch, 1 meaning 1 inch, 2½ meaning 2½ inches, etc. with the "−" meaning to place the horizontal flange of the angle iron the indicated distance below the top of the top flange of the support girder, or the "+" meaning to place the horizontal flange of the angle iron the indicated amount above the top of the top flange of the support girder. The angle irons are then held in proper position by workers on the erected girders and are welded to the ends of the straps placed on the top of the top flange of the girders, again, by workers on the girders, while being held in place. This is a difficult and time consuming job. Further, it is important that when welding the angle irons to the straps on the girders that no welding arc between the angle irons or straps and the girder occur. In addition, it is important that no arcing occur between the welding equipment or wires to the welding equipment and the girders. Any arcing to a girder can damage the girder requiring expensive examination and repair of the girder. A further concern is that the welding produces toxic fumes. With workers holding the angle irons in proper position against the straps and other workers welding the ends of the straps to the angle irons, all in cramped conditions on top of the girder which is generally a significant height above the ground, it is difficult to keep workers from inhaling the toxic fumes.

It has been recognized that it would be advantageous to be able to more easily position and adjust the position of the deck pans when installing the deck pans between the bridge girders.

SUMMARY OF THE INVENTION

According to the invention, the angle irons used to support the deck pans are assembled to the straps, generally loosely assembled to the straps, and placed on the support girders prior to erection of the girders thereby requiring only adjustment of the vertical positioning of the angle irons with respect to the support girders and tightening of the angle irons to the straps when in position after erection of the support girders. The angle irons and straps can be assembled together on the girders with the girders on a floor or on the ground prior to erection, or the angle irons can be assembled to the straps to form an assembly of two parallel lengths of angle irons secured to opposite sides of the straps and spaced by the straps, which assembly can then be placed, as an assembly, on a support girder either before erection or after erection. The angle irons are adjustably secured to the straps so that with the support girders erected and the survey done so that the needed positioning of the angle irons with respect to the top of the top flange of the support girder is known, the angle irons can be easily positioned at the proper vertical position and then tightened to the straps. No welding of the angle irons to the straps on the erected support girders is necessary.

In one embodiment of the invention, the straps include substantially vertical end portions and one or the other or both of the strap end portions and angle irons are slotted. The angle iron is bolted to the strap with the slot or slots providing sliding adjustment between the two when the bolt is loose. The loose assembly of angle irons and straps are either assembled on top of the support girder or are assembled as a separate assembly and placed on top of the support girder. After the support girders are erected, surveyed, and marked, workers on top of the girder position the loosely attached angle irons in accordance with the survey markings and tighten the connection between the angle irons and the straps. When tightened, the angle iron is securely held to the strap and in adjusted vertical position with respect to the top of the top flange of the support girder on which the strap rests. When bolts are used to connect the angle irons to the straps, this merely involves tightening the bolts. This can be done with fewer workers and without welders on the top of the girders so is safer and less expensive.

Once the angle irons are properly positioned and tightened to the straps, the deck pans are placed on and supported by the extending horizontal side of the angle iron in normal prior art manner and concrete is poured over the deck pans and girders in normal prior art manner to produce the normal concrete deck.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein:

FIG. 4 is a fragmentary top view of a support girder with the support system of the invention in place thereon showing adjacent ends of angle irons connected end-to-end on opposite longitudinal sides of the support girder;

FIG. 4A is an enlargement of the circled portion of FIG. 4 to better show details;

FIG. 5 is a fragmentary side elevation of one side of the support girder shown in FIG. 4 with the end-to-end arrangement of angle irons shown in FIG. 4;

FIG. 5A is an enlargement of the circled portion of FIG. 5 to better show details;

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Figures 1, 1A:
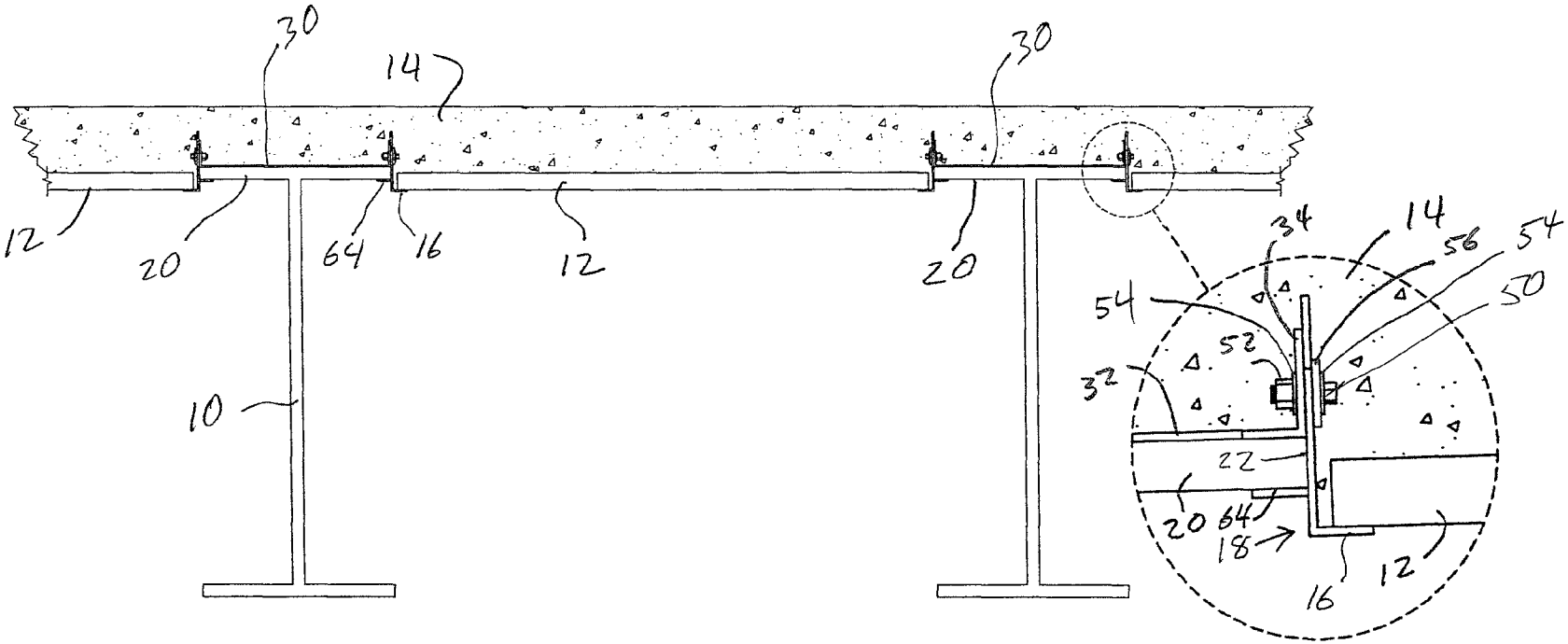
FIG. 1 is a fragmentary vertical section through a concrete deck structure, such as a concrete deck highway bridge, made in accordance with an embodiment of the present invention.
FIG. 1A is an enlargement of the circled portion of FIG. 1 to better show details.
Figures 2, 2A:
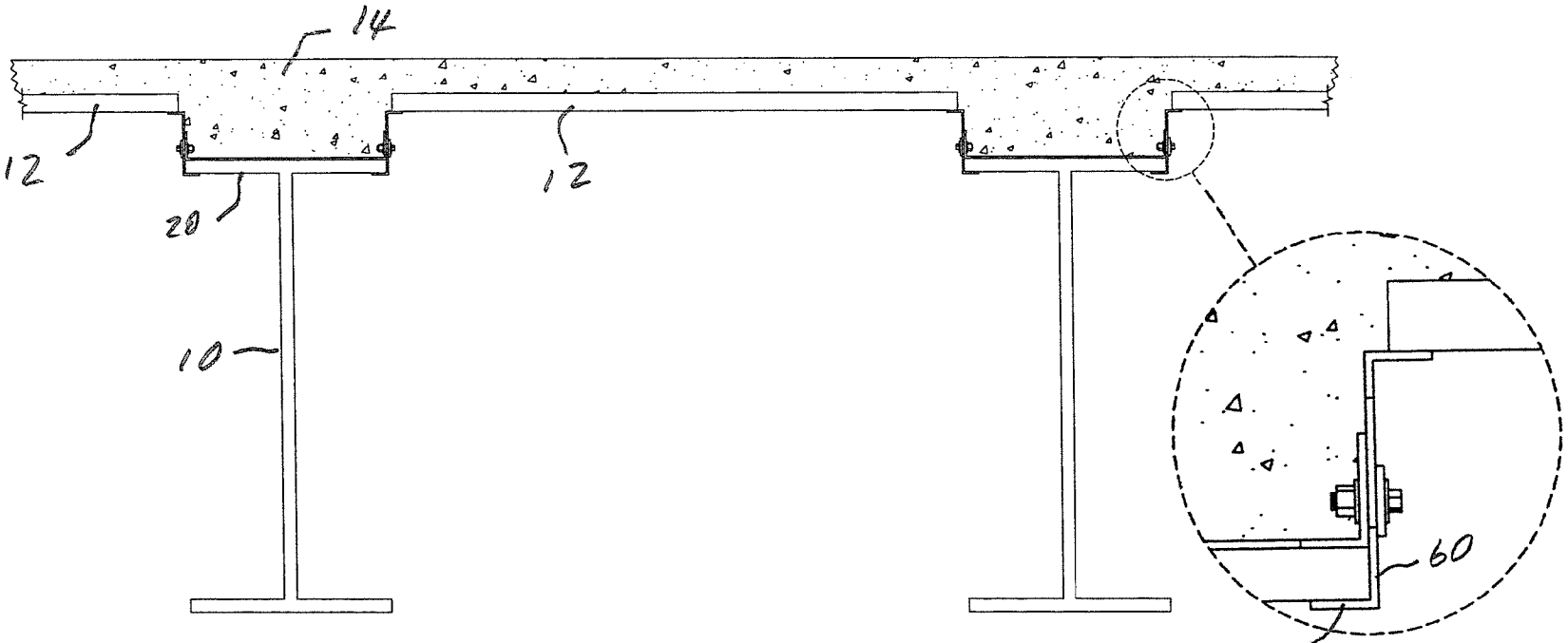
FIG. 2 is a fragmentary vertical section similar to that of FIG. 1, but showing a different orientation of the components of the invention.
FIG. 2A is an enlargement of the circled portion of FIG. 2 to better show details.

In the construction of concrete decks, such as concrete decks for highway bridges, structural supports, such as a plurality of parallel support girders 10, FIG. 1 showing two such support girders, are erected to support the deck. When constructing the deck using "stay-in-place" formwork, deck pans 12, usually formed of sheets of corrugated galvanized steel, are positioned between the girders, and concrete 14 is poured over the deck pans and girders to form the deck. The deck pans 12 are supported by the horizontally extending sides 16 of angle irons 18 which are positioned to extend along the sides of top flanges 20 of support girders 10. As indicated in the Prior Art Section, once the support girders are erected, the girders are surveyed and from the survey it is determined where the angle irons should be positioned with respect to the top of the girder top flange to place the angle iron horizontal side 16 at a vertical position with respect to the top of the support girder top flange to support the deck pan 12 so as to provide the desired surface contour of the finished concrete deck. The determined position of the angle iron at a particular location along the length of the support girder is marked on the top of the top flange of the support girder usually as either a "−" meaning "cut" or a "+" meaning "fill" along with a measurement such as ½, meaning ½ inch, 1 meaning 1 inch, 2½ meaning 2½ inches, etc. with the "−" meaning to place the horizontal flange of the angle iron the indicated distance below the top of the top flange of the support girder, or the "+" meaning to place the horizontal flange of the angle iron the indicated distance above the top of the top flange of the support girder. FIGS. 1 and 1A show the angle irons 18 in "−" or "cut" position with the horizontal side 16 of the angle irons 18 extending away from support girder 10 below the top flange 20 to thereby support deck pan 12 below the top of the top flange 20. FIGS. 2 and 2A show the angle irons 18 in "+" or "fill" position with the horizontal side 16 of the angle iron 18 extending away from support girder 10 above the top of top flange 20 to thereby support deck pan 12 above the top flange 20. Also in FIGS. 2 and 2A, the angle iron 18 is in reversed or upside down orientation compared to the orientation shown in FIGS. 1 and 1A so that the horizontally extending side 16 which supports the deck pan 12 is at the top of the vertically extending side 22. This allows the deck pan 12 to be supported higher above the top of the girder flange 20 than when the angle iron is oriented as shown in FIGS. 1 and 1A.

Current (prior art) practice is to place a flat strap over the top surface of the top flange 20 of the erected girders 10 and to then weld the end of the flat strap to the vertical sides 22 of the angle iron 18 to secure the horizontally extending side 16 of the angle iron at the desired vertical height with respect to the top of the girder top flange 20. The system of the current invention does away with the welding of the end of the strap to the vertical side of the angle iron.

Figure 3:
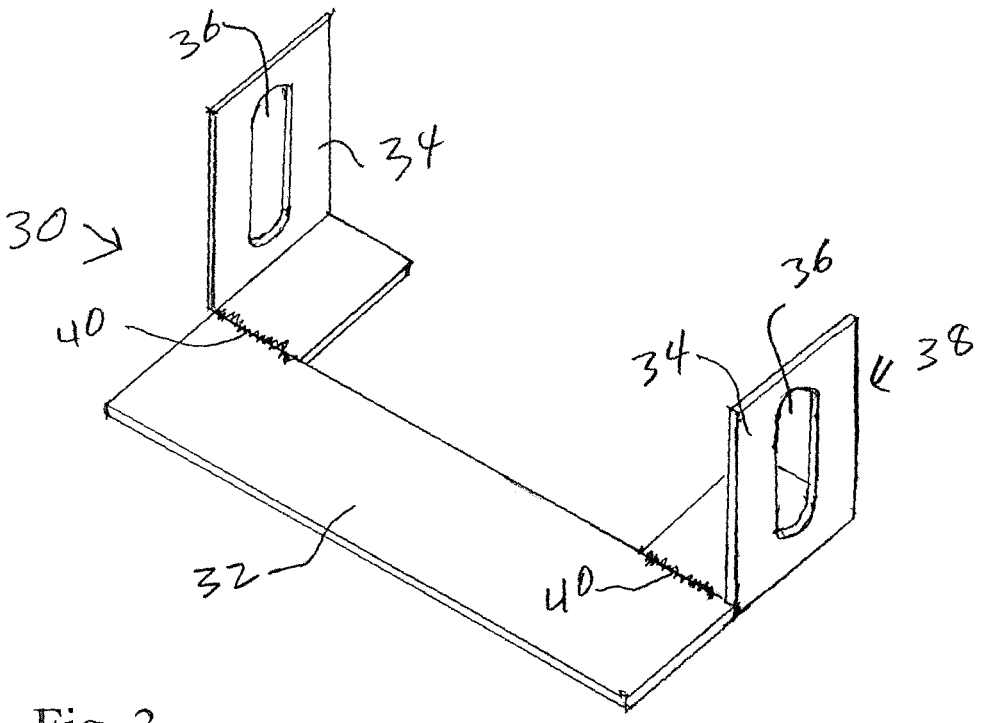
FIG. 3 is a pictorial view of a strap of the invention.

In the illustrated embodiment of the invention, the straps 30, FIG. 3, have a flat straight portion 32 and, rather than having just a flat end as in the prior art, include substantially vertical end portions 34 with slots 36 therein at opposite ends of the flat straight portion 32. The width of straps 30 is such that the substantially vertical portions are substantially aligned with the edges of the top surface of a top flange 20 of a support girder 10, see FIGS. 1 and 2. While the straps 30 could be of single piece construction, the straps 30 are illustrated as made with a flat straight portion 32, such as used in the prior art, with angle pieces 38, which form the substantially vertical portions, welded thereto as at 40. Since different size girders have different width top flanges, the three piece strap construction allows the strap to be made to fit specific widths of support girder top flanges. Also, the three piece strap construction allows the straps of the prior art (flat straight portions 32) to be converted to straps of the current invention.

Figure 7:
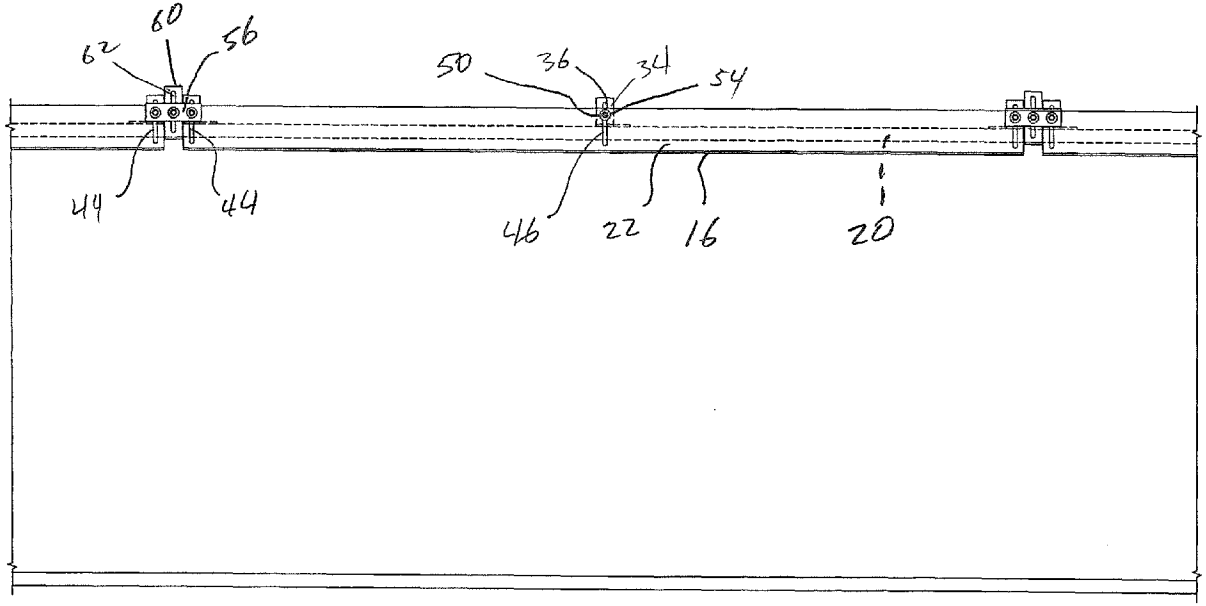
FIG. 7 is a fragmentary side elevation of one side of the support girder shown in FIG. 6 with the end-to-end arrangement of angle irons shown in FIG. 6.

Also in the illustrated embodiment of the invention, the angle irons 18 are provided with slots 44, FIGS. 5, 5A, and 7, through the end portions of the vertical sides 22 of the angle irons 18, and, depending upon the length of the angle irons, usually through at least one intermediate location 46, FIG. 7, between the ends.

Figure 6:
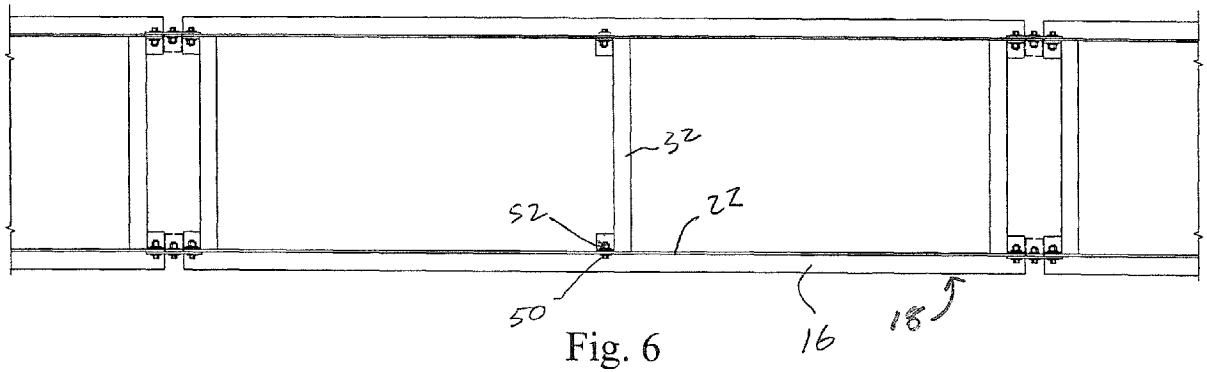
FIG. 6 is a fragmentary top view of a support girder with the support system of the invention in place thereon showing an arrangement of end-to-end angle irons on opposite longitudinal sides of the support girder with adjacent ends of the angle irons connected end-to-end as shown in FIG. 4.

With the present invention, the angle irons 18 can be installed on the support girders prior to erection of the support girders, and then, after erection and surveying, the vertical positions of the angle irons can be adjusted and the angle irons secured in the adjusted positions. Prior to the erection of the support girders, either in a shop location or at the erection location, while the support girders are on a floor or on the ground, workers can position the straps 30 on the top surface of the top flange 20 of the support girders 10, and can attach the angle irons 18 to the substantially vertical end portions 34 of the straps with bolts 50 passed through aligned slots 44 of the vertical sides 22 of the angle irons and slots 36 of the vertical portions 34 of the straps 30. The angle irons and straps can advantageously be loosely attached. For an intermediate slot 46, FIGS. 6 and 7, the vertical side 22 of the angle iron is bolted directly to the substantially vertical end portion 34 of the strap, with bolt 50 and nut 52, FIG. 6. Washers 54 are generally placed against the bolt head 50 and the nut 52. Nut 52 can be a Teflon locking nut which will stay in place and resist turning even when loosely screwed onto bolt 50, but still allow tightening when desired. At the end portions of the angle irons 18 where the angle irons are joined together end-to-end, FIGS. 4, 4A, 5, 5A, 6, and 7, a securement strip 56 is provided with holes through which bolts 50 pass when passing through the aligned slots 44 and 36 of respective end portions of adjacent angle irons and substantially vertical end portions 34 of straps 30. Strip 56 will position and maintain the position of adjacent end-to-end angle irons. Also, it may be advantageous to provide a wind clip 60 between adjacent ends of the angle irons. Wind clip 60 secures the angle iron assembly to the support girder in case of wind conditions which might otherwise blow the assembly off of the support beams, particularly when the deck pans are in place, prior to the addition of the concrete. Wind clip 60 is an angle with a slot 62, FIGS. 5 and 5A, in the vertical side of the angle and with the horizontally extending side 64, FIGS. 1A, 2A, 4A, and 5A, extending outwardly below the girder top flange 20. With adjacent straps 30 extending across the top girder surface between adjacent ends of adjacent angle irons, and with securement strip 56 extending between the adjacent straps 30, and with a wind clip 60 between the angle iron ends, a bolt 50 extending through the securement strip and the wind clip slot 62 can secure the horizontally extending side 64 of the wind clip 60 tightly under the girder top flange 20 to securely hold the angle iron assembly to the support girders. Currently, wind clips to hold a deck pan assembly in position in case of high winds are required by code in most states to be positioned at ten foot intervals along the angle irons.

While the angle iron assemblies will generally be installed on the support girders prior to erection, in some cases one or more lengths of angle iron may be left off the girder to provide space for attachment to a crane for lifting the girders into place during erection without damaging the angle iron assembly. In such case, an angle iron assembly can then be lifted onto the top of the support girder into the open length and attached to the ends of adjacent angle irons as describe.

While spacing and sizes of components can vary, the straps should usually be placed about every eighteen to twenty four inches. The flanges on the support girder will usually be between about twelve to thirty six inches. Support girders will usually be about eight feet apart. The angle irons will usually be between about eight and ten feet in length.

The invention provides that the majority of the installation can be performed on the ground eliminating the fall potential inherent to working at heights. Also the bolted connections in place of welded connections eliminate the potential of inhaling toxic fumes generated by welding galvanized metal. The limited welding required can be performed in a shop under controlled conditions using ventilation systems. Further, the elimination of welding on the girders eliminates the potential for arc strikes on girders. Arc strikes on girders require specialized repairs and can potentially compromise the structural integrity of the girder. Further, the system of the invention allows the change of angle iron positions at any time during installation should this become necessary by merely loosening the bolts, adjusting the position of the angle iron, and retightening the bolts. Cost advantages are also provided because the system allows for shop assembly and installation by shop labor which is cheaper than field labor costs, certified welders are not required for field and top of girder assembly, and total man hours required for installation is reduced.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. An apparatus for supporting and positioning stay in place metal decking between support girders, said support girders having a substantially horizontal top surface with opposite side edges defining a width of the substantially horizontal top surface, comprising:

a plurality of straps for placement on the substantially horizontal top surface of the support girder and having an intermediate portion with opposite ends and substantially vertical end portions at the opposite ends of the intermediate portion substantially aligned with the opposite edges of the substantially horizontal top surface, each of said substantially vertical end portions having an end portion attachment opening therein;

a pair of angle irons, one side of each angle iron forming a height side of the angle iron having a substantially vertical height and having a plurality of angle iron attachment openings spaced along the height side thereof, said angle iron attachment openings positioned to align with the end portion attachment openings of respective straps, and to receive fasteners therethrough, wherein at least one of the end portion attachment opening and the angle iron attachment opening is elongate to allow vertical movement of the angle iron with respect to the end portion, whereby a fastener passing through an angle iron attachment opening in a respective angle iron and through the aligned end portion attachment opening in a respective strap allows vertical adjustment of the position of the respective angle iron with respect to the end portions of the respective straps, and another side of each angle iron forming a width side of the angle iron for holding the edge of a metal decking pan.

2. An apparatus for supporting and positioning stay in place metal decking between support girders according to claim 1, wherein the angle irons have a length shorter than the length of the support girders so that a plurality of lengths of angle irons are positioned adjacent one another end to end along a side of a single support girder, and additionally including a wind clip secured between the ends of adjacent angle irons to secure the apparatus to the top of the girders.

3. An apparatus for supporting and positioning stay in place metal decking between support girders according to claim 2, wherein a wind clip securement strip is secured between the ends of adjacent angle irons and the wind clip is adjustably secured to the wind clip securement strip.

4. An apparatus for supporting and positioning stay in place metal decking between support girders according to claim 3, wherein the wind clip has a slot therein and the wind clip is adapted to be adjustably secured to the wind clip securement strip by a bolt passing through the wind clip securement strip and the slot in the wind clip.

5. An apparatus for supporting and positioning stay in place metal decking between support girders according to claim 1, wherein the angle iron attachment openings and the end portion attachment openings are slots.

6. An apparatus for supporting and positioning stay in place metal decking between support girders according to claim 1, wherein the angle iron attachment openings are slots.

7. An apparatus for supporting and positioning stay in place metal decking between support girders according to claim 1, wherein the end portion attachment openings are slots.

8. An apparatus for supporting and positioning stay in place metal decking between support girders according to claim 1, additionally including fasteners passing through aligned angle iron attachment openings and end portion attachment openings, wherein the fasteners are bolts.

9. An apparatus for supporting and positioning stay in place metal decking between support girders, said support girders having a substantially horizontal top surface with opposite side edges defining a width of the substantially horizontal top surface, comprising:

a plurality of straps for placement on the substantially horizontal top surface of the support girder and each having an intermediate portion with opposite ends and substantially vertical end portions at the ends of the intermediate end portion thereof substantially aligned with the opposite edges of the substantially horizontal top surface;

a pair of angle irons, one side of each angle iron forming a height side of the angle iron for adjustable attachment to the vertical end portions of the straps, and another side of each angle iron forming a width side of the angle iron and having a width sufficient for holding the edge of a metal decking pan;

wherein each of the vertical sides of the angle irons and the vertical end portions of the straps include slots therein in alignment with one another to receive a fastener extending therethrough to secure the vertical side of the angle iron to the vertical end portions of the straps in a vertically adjusted position of the angle irons with respect to the vertical end portions of the straps.

10. An apparatus for supporting and positioning stay in place metal decking between support girders according to claim 9, additionally including fasteners passing through aligned angle iron attachment openings and end portion attachment openings, wherein the fasteners are bolts.

11. A method tor supporting and vertically positioning stay in place metal decking between support girders having a substantially horizontal top surface with opposite side edges defining a width of the substantially horizontal top surface of the support girders and with the metal decking at a desired vertical position relative to the substantially horizontal top surface of the support girders, comprising:

obtaining a plurality of straps having an intermediate portion with opposite ends and substantially vertical end portions at the ends thereof, said end portions having an end portion attachment opening therein and said straps having a length between the end portions substantially equal to the width of the girder top surface;

obtaining a pair of angle irons, one side of each angle iron forming a height side of the angle iron having a substantially vertical height and having a plurality of angle iron attachment openings spaced along the height side thereof, and another side of each angle iron forming a width side of the angle iron having a substantially horizontal width for holding the edge of a metal decking pan;

wherein at least one of the end portion attachment opening and the angle iron attachment opening is elongate to allow vertical movement of the angle iron with respect to the end portion when a fastener is passed through an angle iron attachment opening and an aligned end portion attachment opening;

securing the pair of angle irons in spaced parallel orientation by aligning end portion attachment openings of respective substantially vertical end portions of the plurality of straps with angle iron attachment openings spaced along the height side of respective angle irons and passing a fastener through aligned attachment openings to attach respective spaced parallel angle irons to form an assembly of the spaced parallel angle irons;

positioning the assembly of spaced parallel angle irons on the top of a support girder with the straps extending across the width of the substantially horizontal top surface of the support girder and the respective angle irons suspended along opposite sides of the substantially horizontal top surface of the support girder from the substantially vertical end portions of the straps;

adjusting the vertical position of the angle irons with respect to the substantially vertical end portions of the straps and securing the angle irons in the adjusted positions with the fasteners.

12. A method for supporting and vertically positioning stay in place metal decking between support girders according to claim 11, wherein the step of securing the pair of angle irons in spaced parallel orientation is the step of loosely securing the pair of angle irons in spaced parallel orientation.

13. A method for supporting and vertically positioning stay in place metal decking between support girders according to claim 12, wherein the step of loosely securing the pair of angle irons in spaced parallel orientation is performed at a location remote from the support girders and the step of positioning the assembly of spaced parallel angle irons on the top of a support girder includes the step of moving the assembly of spaced parallel angle irons from the remote location to the top of the support girder.

14. A method for supporting and vertically positioning stay in place metal decking between support girders according to claim 12, wherein the step of loosely securing the pair of angle irons in spaced parallel orientation is performed on the top of the support girder.

15. A method for supporting and vertically positioning stay in place metal decking between support girders according to claim 12, wherein the step of passing a fastener through aligned attachment openings is the step of passing bolts through the aligned attachment openings, wherein the step of loosely securing the pair of angle irons in spaced parallel orientation is the step of loosely securing the bolts through the aligned attachment openings, and wherein the step of securing the angle irons in the adjusted positions is the step of tightening the bolts passing through the attachment openings when the vertical position of the angle irons with respect to the substantially vertical end portions of the straps have been adjusted.

16. An apparatus for supporting and positioning stay in place metal decking between support girders, said support girders having a substantially horizontal top surface with opposite side edges defining a width of the substantially horizontal top surface, comprising:

a plurality of straps associated with the support girders and having substantially vertical strap portions substantially aligned with the opposite edges of the substantially horizontal top surface of the girders, each of said substantially vertical strap portions having a strap portion attachment opening therein;

a pair of angle irons, one side of each angle iron forming a height side of the angle iron having a substantially vertical height and having a plurality of angle iron attachment openings spaced along the height side thereof, said angle iron attachment openings positioned to align with strap portion attachment openings of respective substantially vertical strap portions, and to receive fastener therethrough, wherein at least one of the strap portion attachment opening and the angle iron attachment opening is elongate to allow vertical movement of the angle iron with respect to the substantially vertical strap portion, whereby a fastener passing through an angle iron attachment opening in a respective angle iron and through the aligned strap portion attachment opening in a respective substantially vertical strap portion allows vertical adjustment of the position of the respective angle iron with respect to the respective strap and thereby with respect to the top of the girder, and another side of each angle iron forming a substantially horizontal width side of the angle iron for holding the edge of a metal decking pan.

17. An apparatus for supporting and positioning stay in place metal decking between support girders according to claim 16, wherein the angle iron attachment openings and the strap portion attachment openings are slots.

* * * * *